US005711428A

United States Patent [19]

Ho

[11] Patent Number: 5,711,428

[45] Date of Patent: Jan. 27, 1998

[54] TOOL BOX

[76] Inventor: Chiu-Fu Ho, No. 5, 8-1 Alley, 44 Lane, 1 Sec., Hsin Jen Road, Tai-Ping Hsiang, Taichung Hsien, Taiwan

[21] Appl. No.: 764,944

[22] Filed: Dec. 13, 1996

[51] Int. Cl.[6] ..... B65D 85/20

[52] U.S. Cl. ..... 206/738; 206/759; 206/372

[58] Field of Search ..... 206/372–382, 206/738, 752, 759

[56] References Cited

U.S. PATENT DOCUMENTS

| | | | |
|---|---|---|---|
| 3,583,556 | 6/1971 | Wagner | 206/373 |
| 4,006,821 | 2/1977 | Sautter | 206/379 |
| 4,660,719 | 4/1987 | Peterson et al. | 206/372 |
| 4,955,478 | 9/1990 | Rau et al. | 206/379 |
| 5,190,154 | 3/1993 | Reusch | 206/373 |
| 5,368,164 | 11/1994 | Bennett et al. | 206/379 |
| 5,570,784 | 11/1996 | Sidabras et al. | 206/379 |

*Primary Examiner*—Jimmy G. Foster
*Attorney, Agent, or Firm*—Charles E. Baxley, Esq.

[57] ABSTRACT

A tool box includes a receiving member and a receiver pivotally received in the receiving member, the receiver having a plurality of tubular recesses defined therein for receiving bits therein and two shafts respectively extending laterally from each one of two sides thereof, the receiving member having a hole and a slot defined in each one of two side walls thereof such that the receiver is received in the receiving member by rotatably inserting the shafts into the holes via the slots.

4 Claims, 2 Drawing Sheets

TOOL BOX

BACKGROUND OF THE INVENTION

1. Field of the Invention

The present invention relates to a tool box and more particularly, to a tool box which includes a receiver pivotally disposed to a receiving case wherein the receiver has two shafts extending integrally and laterally therefrom which pivotally mounted between two side walls of the receiving case such that the receiver is rotated by rotating the shafts.

2. Brief Description of the Prior Art

A known tool box is constructed to be a box including a receiving portion and a cover which is pivotally connected to the receiving portion. The receiving portion has a plurality of recesses defined in an inner bottom thereof so as to receive bits therein. Each of the recesses has an enlarged portion such that user's fingers can be inserted therein to pick the bit received therein out. Each of the enlarged portions is generally designed to be a limited recessed area such that the tool box will not occupy too much room to be carried. However, user's fingers often are larger than the enlarged portions such that it is difficult to pick the bits conveniently. Furthermore, if the user's fingers are adhered with grease then it will be found that such a tool box is not a well designed product.

The present invention intends to provide an improved tool box which has a transparent receiver pivotally connected to a receiving case such that the receiver can be pivoted corresponding to the receiving case and the bits received in the receiver can be withdrawn easily. The present invention therefore mitigates and/or obviates the above-mentioned problems.

SUMMARY OF THE INVENTION

In one aspect of the present invention, there is provided a tool box comprising a receiving member which includes a bottom and two side walls, a front wall and a rear wall respectively extend from a periphery of the bottom. Each of the two side walls has a hole and a slot respectively defined therethrough and each of the slots communicates with the hole corresponding thereto and accesses to an upper edge of the side wall corresponding thereto.

A receiver has a plurality of tubular recesses defined therein for receiving bits in the tubular recesses and each one of two side walls has a shaft extend laterally therefrom such that the receiver is pivotally received in the receiving member by rotatably inserting the shafts into the two holes via the slots.

It is an object of the present invention to provide a tool box having a receiver pivotally received in a receiving member of the tool box.

It is another object of the present invention to provide a receiver which has two shafts extending therefrom and the receiver is rotated by operating the shafts.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
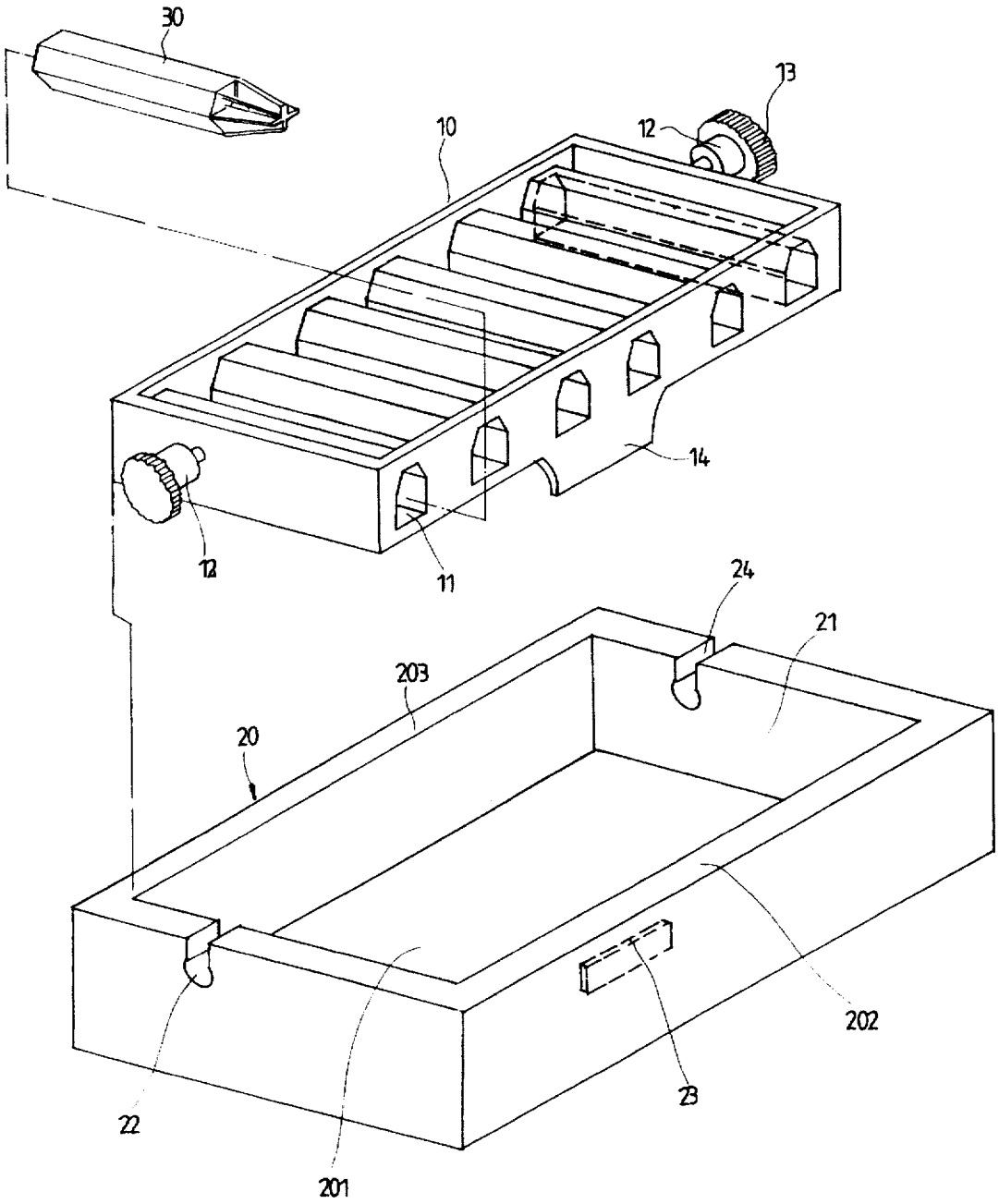
FIG. 1 is an exploded view of a tool box in accordance with the present invention.
Figure 2:
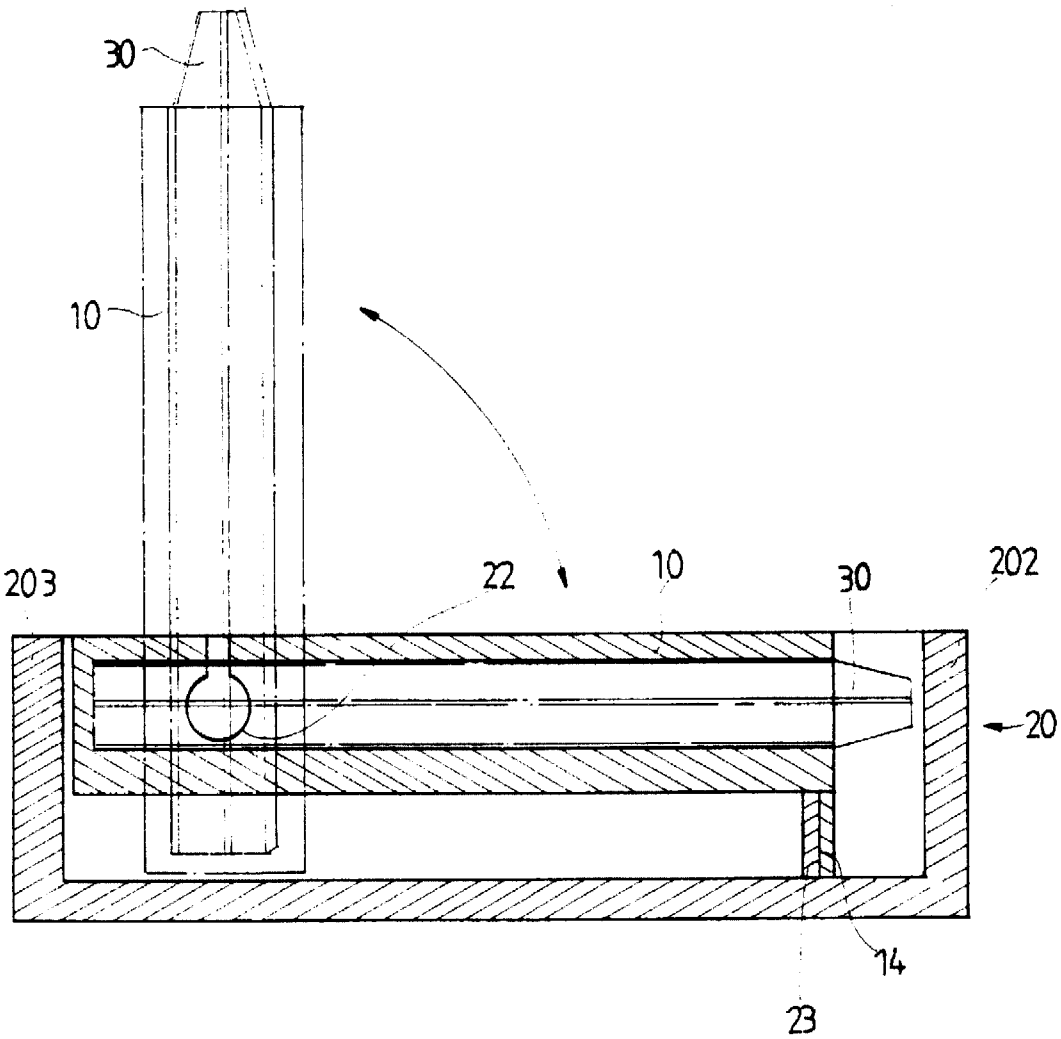
FIG. 2 is a side elevational view, partly in section, of the tool box to show a receiver of the tool box is able to be rotated upwardly.

Referring to FIGS. 1 and 2, a tool box in accordance with the present invention generally includes a receiving member 20 and a receiver 10 which is pivotally received in the receiving member 20. The receiving member 20 includes a bottom 201, two side walls 21, a front wall 202 and a rear wall 203 respectively extend from a periphery of the bottom 201 so as to form a rectangular receiving member 20 with an open top. Each of the two side walls 21 has a hole 22 and a slot 24 respectively defined therethrough wherein each of the slots 24 communicates with the hole 22 corresponding thereto and accesses to an upper edge of the side wall 21 corresponding thereto.

The receiver 10 is made of transparent material and has a plurality of tubular recesses 11 defined therein for receiving bits 30 in the tubular recesses 11. The receiver 10 has a shaft 12 extending from each one of the two sides thereof and each of the shafts 12 has a head 13 formed on a free end thereof wherein each of the heads 13 has a knurled outer circumference. The receiver 10 is received in the receiving member 20 by rotatably inserting the shafts 12 into the two holes 22 via the slots 24.

The receiving member 10 has a first plate 14 extending downwardly from a bottom thereof and the receiving member 20 has a second plate 23 extending upwardly from an upper face of the bottom 201 such that when the receiver 10 is received in the receiving member 20, the first plate 14 contacting the second plate 23 snugly and adjacently to position the receiver 10.

Accordingly, the receiver 10 is rotated upwardly by rotating the shafts 12 such that bits 30 are easily to be picked.

Although the invention has been explained in relation to its preferred embodiment, it is to be understood that many other possible modifications and variations can be made without departing from the spirit and scope of the invention as hereinafter claimed.

What is claimed is:

1. A tool box comprising:

a receiving member including a bottom, two side walls, a front wall and a rear wall wherein said two side walls, said front wall and said rear wall respectively extend from a periphery of said bottom, each of said two side walls having a hole and a slot respectively defined therethrough wherein each of said slots communicates with said hole corresponding thereto and accesses to an upper edge of said side wall corresponding thereto, and a receiver having a plurality of tubular recesses defined therein and each one of two side walls having a shaft extending laterally therefrom, said receiver received in said receiving member by rotatably inserting said shafts into said two holes via said slots.

2. The tool box as claimed in claim 1 wherein said receiving member has a first plate extending downwardly from a bottom thereof and said receiving member has a second plate extending upwardly from an upper face of said bottom so as to contact said first plate to position said receiver.

3. The tool box as claimed in claim 1 wherein each of said shafts has a head formed on a free end thereof.

4. The tool box as claimed in claim 3 wherein said head has a knurled outer circumference.

* * * * *